US012077404B2

(12) United States Patent
Miyase et al.

(10) Patent No.: US 12,077,404 B2
(45) Date of Patent: Sep. 3, 2024

(54) FEED TRAY AND IMAGE RECORDING APPARATUS

(71) Applicant: Brother Kogyo Kabushiki Kaisha, Nagoya (JP)

(72) Inventors: Satoshi Miyase, Nagoya (JP); Kengo Noda, Inazawa (JP); Yuya Tatematsu, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/586,149

(22) Filed: Jan. 27, 2022

(65) Prior Publication Data

US 2022/0234852 A1 Jul. 28, 2022

(30) Foreign Application Priority Data

Jan. 28, 2021 (JP) ..... 2021-012207

(51) Int. Cl.
*B65H 5/28* (2006.01)
*B65H 1/26* (2006.01)
*B65H 29/60* (2006.01)

(52) U.S. Cl.
CPC ..... *B65H 5/28* (2013.01); *B65H 1/266* (2013.01); *B65H 29/60* (2013.01)

(58) Field of Classification Search
CPC ..... B65H 5/28; B65H 1/266; B65H 29/60; B65H 16/02; B65H 19/30; B65H 2301/417; B65H 2301/41814; B65H 2402/441; B65H 2402/442; B65H 2405/42; B65H 2405/43; B41J 17/26; B41F 13/02
See application file for complete search history.

(56) References Cited

U.S. PATENT DOCUMENTS 5,229,791 A * 7/1993 Kuboki ..... H04N 1/128 347/3
7,165,741 B2 * 1/2007 Takagi ..... B41J 11/06 242/564.4
2015/0054213 A1 * 2/2015 Miyake ..... B65H 1/08 271/127

FOREIGN PATENT DOCUMENTS

JP H09-263348 A 10/1997

* cited by examiner

*Primary Examiner* — Jennifer Bahls
*Assistant Examiner* — Quang X Nguyen
(74) *Attorney, Agent, or Firm* — Banner & Witcoff, Ltd.

(57) ABSTRACT

A feed tray includes a first accommodation part in which a roll body having a configuration where a first sheet-shaped medium is rolled in a roll shape is accommodated, a conveyance guide configured to define a conveyance path for a roll medium which is the first sheet-shaped medium unrolled from the roll body accommodated in the first accommodation part, and a shutter movable between an intercept position where the shutter is located in the conveyance path and a retreat position where the shutter is further from the conveyance path than the intercept position.

5 Claims, 13 Drawing Sheets

FEED TRAY AND IMAGE RECORDING APPARATUS

CROSS-REFERENCE TO RELATED APPLICATION

This application is based upon and claims the benefit of priority from prior Japanese patent application No. 2021-012207 filed on Jan. 28, 2021, the entire contents of which are incorporated herein by reference.

TECHNICAL FIELD

The present disclosure relates to a feed tray capable of accommodating a roll body, and an image recording apparatus having the feed tray.

BACKGROUND

An image recording apparatus including a feed tray capable of accommodating a roll body having a configuration where a sheet-shaped medium such as a paper, a cloth and a label is rolled in a roll shape is known. For example, JP-A-H09-263348 discloses a roll sheet feeding apparatus (image recording apparatus) having a sheet feeding tray (feed tray) configured to accommodate a roll sheet (roll body), a housing configured to detachably hold the sheet feeding tray, and a drive roller (feed roller) for feeding the roll sheet accommodated in the sheet feeding tray to an image forming unit (recording unit).

In the configuration of JP-A-H09-263348, a roll medium, which is a sheet-shaped medium unrolled from the roll body accommodated in the feed tray, is fed by the feed tray. In general, insertion of the feed tray into the housing is performed in a state where the roll medium is unwound from the roll body by a predetermined length. Since the length of the roll medium to be unrolled can be arbitrarily determined by an operator, the unrolled roll medium may become excessively long. In this case, when inserting the feed tray into the housing, a tip end of the unrolled roll medium may come into contact with a member inside the housing, which may cause a jam.

SUMMARY

An object of the present disclosure is to provide a feed tray and an image recording apparatus capable of suppressing a roll medium unrolled from a roll body from coming into contact with a member inside a housing when the feed tray is inserted into the housing.

An aspect of the present disclosure is a feed tray including:

- a first accommodation part in which a roll body having a configuration where a first sheet-shaped medium is rolled in a roll shape is accommodated;
- a conveyance guide configured to define a conveyance path for a roll medium which is the first sheet-shaped medium unrolled from the roll body accommodated in the first accommodation part; and
- a shutter movable between an intercept position where the shutter is located in the conveyance path and a retreat position where the shutter is further from the conveyance path than the intercept position.

Another aspect of the present disclosure is an image recording apparatus including:

- a housing;
- the above feed tray configured to be capable of being inserted into and pulled out from the housing;
- a feed roller configured to feed the roll medium from the feed tray by applying a feeding force to the roll medium; and
- a recording unit configured to record an image on the roll medium fed by the feed roller.

According to the feed tray and the image recording apparatus of the present disclosure, by setting the shutter to the intercept position, it is possible to suppress the roll medium unrolled from the roll body and guided to the conveyance path from becoming excessively long. This makes it possible to suppress the roll medium unrolled from the roll body from coming into contact with a member inside the housing when inserting the feed tray into the housing of the image recording apparatus. In addition, by setting the shutter to the retreat position, it is possible to convey the roll medium along the conveyance path.

DETAILED DESCRIPTION

First Embodiment

Hereinafter, a printer 100 (the image recording apparatus of the present disclosure) according to a first embodiment of the present disclosure will be described with reference to FIG. 1. Note that, the upper and lower direction, the front and rear direction and the right and left direction shown in FIG. 1 are referred to as the upper and lower direction, the front and rear direction and the right and left direction of the printer 100.

(Overall Configuration of Printer 100)

Figure 1:
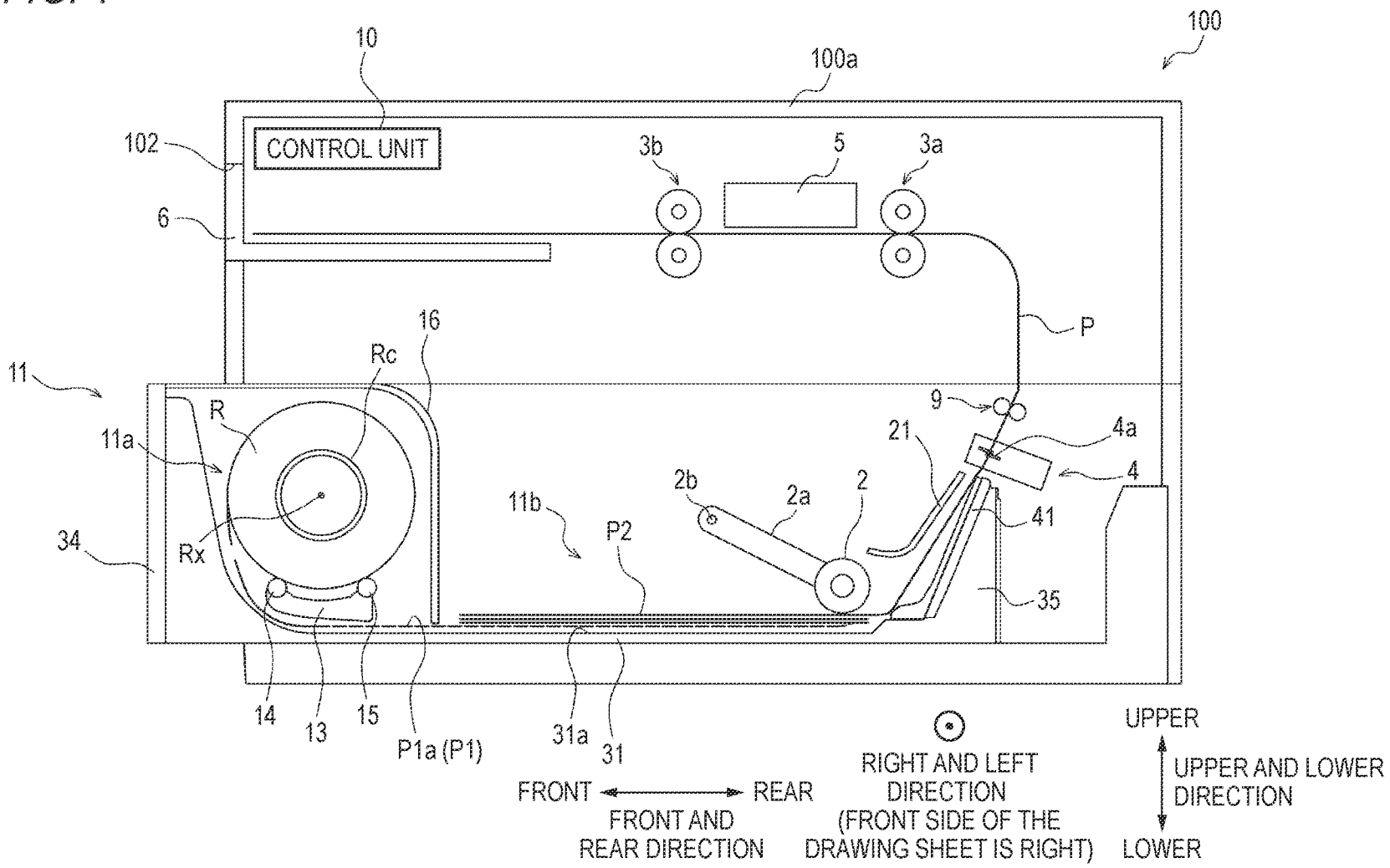
FIG. 1 is a schematic side view showing an internal structure of a printer according to a first embodiment of the present disclosure.

As shown in FIG. 1, the printer 100 includes a housing 100*a*, a feed tray 11, a feed roller 2, a separating piece 41, a pair of conveying rollers 3*a*, a pair of sheet discharging rollers 3*b*, a cutter mechanism 4, a head 5 (the recording unit of the present disclosure), a sheet discharging tray 6, an intermediate roller pair 9, and a control unit 10. The sheet discharging tray 6 is configured to be capable of being inserted into pulled out from the housing 100*a* in the front and rear direction via an opening 102 formed in a front wall of the housing 100*a*.

The feed tray 11 is configured to be capable of being inserted into and pulled out from a lower part of the housing 100*a*. The feed tray 11 has a first accommodation part 11*a* capable of accommodating a roll body R having a configuration where a long-length sheet P1 (the first sheet-shaped medium of the present disclosure) is rolled in a roll shape and a second accommodation part 11*b* capable of accommodating a cut sheet P2 (the second sheet-shaped medium of the present disclosure), which is a sheet shorter than the long-length sheet P1, in a state of being multiply stacked in the upper and lower direction. The cut sheet P2 is a sheet cut to a fixed size, and in the present embodiment, is a rectangular A4-sized sheet having short and long sides. The cut sheet P2 is accommodated in the second accommodation part 11*b* so that the short sides follow a conveyance direction, which will be described later. Width directions of the roll sheet P1*a* (the roll medium of the present disclosure) unrolled from the roll body R in the feed tray 11 and the cut sheet P2 coincide with the right and left direction. The detailed configuration of the feed tray 11 will be described later.

The feed roller 2 is configured to deliver the roll sheet P1*a* unrolled from the roll body R accommodated in the first accommodation part 11*a* or the cut sheet P2 accommodated in the second accommodation part 11*b* from the feed tray 11. In descriptions below, the roll sheet P1*a* and the cut sheet P2 are referred to as 'sheet P' when they are not distinguished. The feed roller 2 is pivotally supported by a tip end of an arm 2*a*, and is configured to rotate by drive of a feeding motor (not shown). The arm 2*a* is rotatably supported by a support shaft 2*b*. The arm 2*a* is urged by an urging member (not shown) so that the feed roller 2 comes close to a bottom surface of the feed tray 11. When the feeding motor is driven by control of the control unit 10, the feed roller 2 rotates to apply a conveyance force in a direction from the front toward the rear to the sheet P in contact with the feed roller 2. Thereby, the sheet P is delivered from the feed tray 11. Note that, the arm 2*a* is configured to be able to retreat upward when attaching and detaching the feed tray 11 to and from the housing 100*a*.

The separating piece 41 is to prevent double feeding when delivering the cut sheet P2 from the feed tray 11. The separating piece 41 is located on a downstream side of the feed tray 11 in a conveyance direction of the sheet P by the feed roller 2 (a direction from the front toward the rear; in descriptions below, simply referred to as 'conveyance direction'). The separating piece 41 is inclined so that an end portion on a rear side is located further upward than an end portion on a front side. A surface of the separating piece 41 is formed with a fine unevenness pattern. The separating piece 41 is configured to come into contact with a central portion of the cut sheet P2 in the width direction, thereby separating the cut sheet P2 in contact with the feed roller 2 and the other cut sheet P2. The sheet P delivered from the feed tray 11 and coming into contact with the separating piece 41 is guided obliquely upward.

The pair of conveying rollers 3*a* are configured by a drive roller configured to rotate by drive of a conveyance motor (not shown) and a driven roller configured to rotate according to the drive roller. The pair of sheet discharging rollers 3*b* is configured by a drive roller configured to rotate by drive of a sheet discharging motor (not shown) and a driven roller configured to rotate according to the drive roller. When the conveyance motor and the sheet discharging motor, which are not shown, are driven by control of the control unit 10, the pair of conveying rollers 3*a* and the pair of sheet discharging rollers 3*b* rotate to convey the sheet P while sandwiching the sheet P. The pair of conveying rollers 3*a* are located behind the head 5, and the pair of sheet discharging rollers 3*b* are located in front of the head 5. The pair of conveying rollers 3*a* are configured to convey the sheet P forward while sandwiching the sheet P. The pair of sheet discharging rollers 3*b* are configured to convey the sheet P forward while sandwiching the sheet P that is conveyed forward by the pair of conveying rollers 3*a*.

The cutter mechanism 4 is located on a further downstream side than the separating piece 41 with respect to the conveyance direction. The cutter mechanism 4 includes, for example, a cutter 4*a* consisting of a disc-shaped rotating blade and a driven blade, and a cutting motor (not shown) configured to reciprocally drive the rotating blade of the cutter 4*a* in the right and left direction. The roll sheet P1*a* unrolled from the roll body R and conveyed along a conveyance path is cut in the width direction of the roll sheet P1*a* by the rotating blade of the cutter 4*a* as the cutting motor is driven by control of the control unit 10.

The intermediate roller pair 9 is provided on a further downstream side than the cutter mechanism 4 with respect to the conveyance direction and on a further upstream side than the pair of conveying rollers 3*a* with respect to the conveyance direction. The intermediate roller pair 9 is configured by a drive roller configured to rotate by drive of an intermediate motor (not shown) and a driven roller configured to rotate according to the drive roller. When the intermediate motor (not shown) is driven by control of the control unit 10, the intermediate roller pair 9 rotates to convey the sheet P while sandwiching the sheet P. The intermediate roller pair 9 is located above a conveyance guide 21 of the feed tray 11, which will be described later. The intermediate roller pair is configured to convey the sheet P upward while sandwiching the sheet P that is delivered from the feed tray 11 by the feed roller 2 and is then guided obliquely upward by the conveyance guide 21.

The head 5 includes a plurality of nozzles (nozzle) formed on a lower surface and a driver IC (not shown). When the driver IC is driven by control of the control unit 10, ink is ejected from the nozzles, so that an image is recorded on the sheet P at the time when the sheet P conveyed by the feed roller 2, the intermediate roller pair 9 and the pair of conveying rollers 3*a* passes through an image recording position facing the lower surface of the head 5. Note that, the head 5 may be either a line-type configured to eject the ink from the nozzles in a state where a position is fixed or a serial-type configured to eject the ink from the nozzles while moving in the right and left direction. The sheet P on which an image is formed by the head 5 is accommodated on the sheet discharging tray 6.

The control unit 10 is connected to the feeding motor, the intermediate motor, the conveyance motor, the sheet discharging motor, the cutting motor and the driver IC via an internal bus (not shown). The control unit 10 has a CPU (Central Processing Unit), a ROM (Read Only Memory) and a RAM (Random Access Memory). In the ROM, programs and data for the CPU to perform various controls are stored. The RAM is configured to temporarily store data that is used when the CPU runs programs.

(Configuration of Feed Tray 11)

Subsequently, a configuration of the feed tray 11 is described with reference to Fits. 2 to 9. In descriptions below, directions of respective parts of the feed tray 11 are described based on a posture of the feed tray 11 in a state of being mounted to the housing 100*a*. The feed tray 11 has a substantially quadrilateral shape, as seen from above. The feed tray 11 has a bottom wall 31 and sidewalk 32 to 35 provided on edges of the bottom wall 31 and is formed to have a box shape opening upward.

Figure 3:
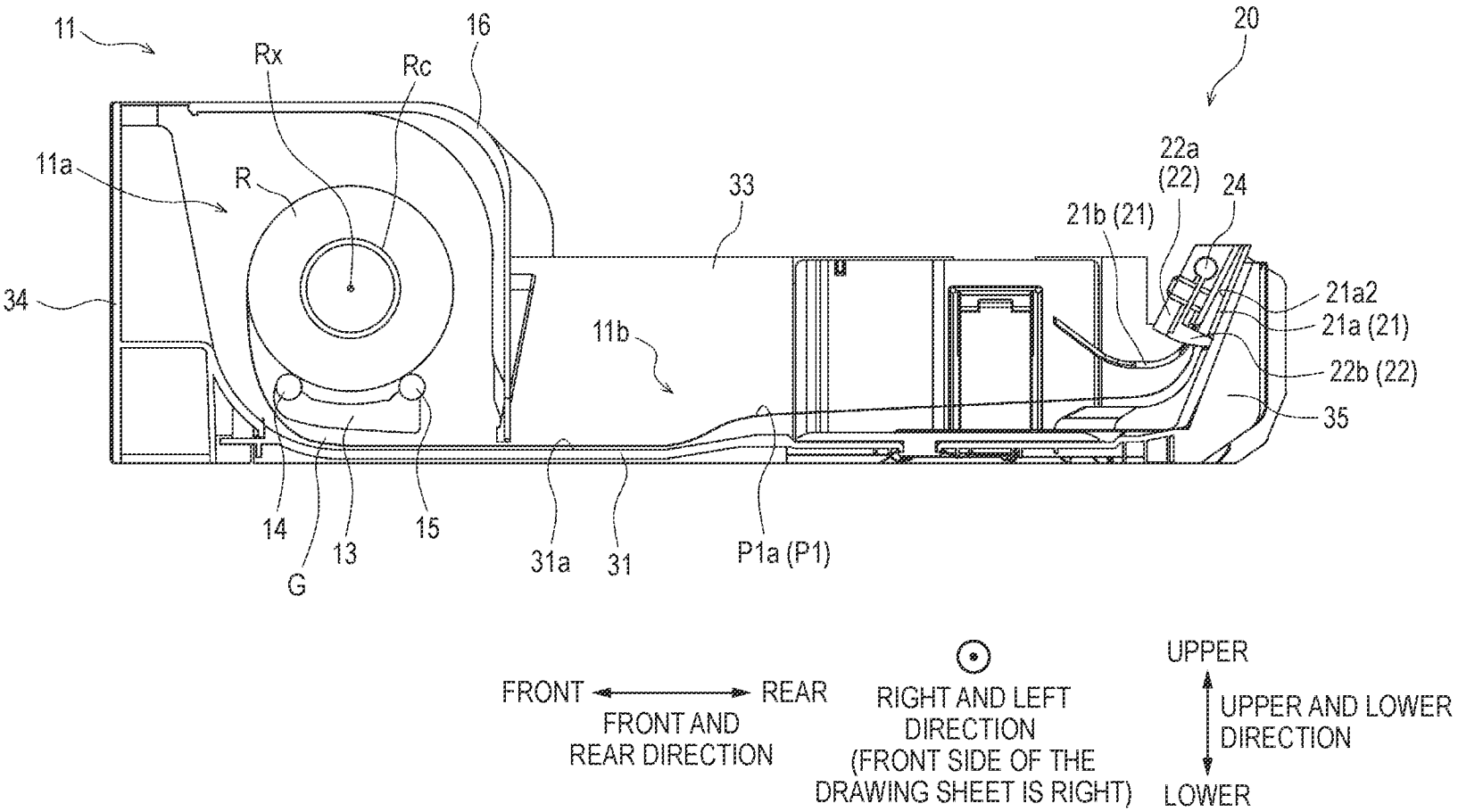
FIG. 3 is a cross-sectional view taken along a III-III line of the feeding tray shown in FIG. 2.
Figure 5:
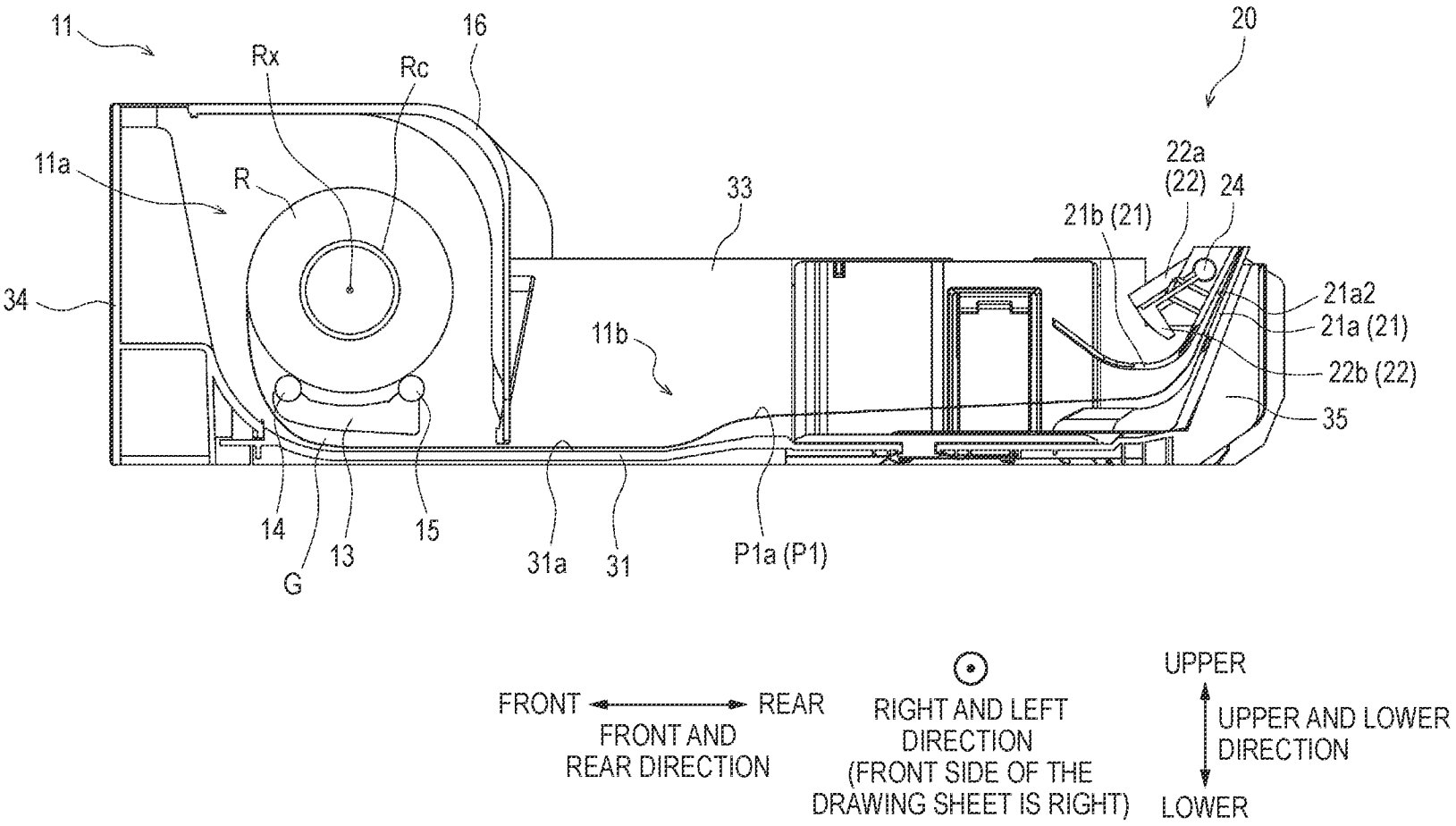
FIG. 5 is a cross-sectional view taken along a V-V line of the feeding tray shown in FIG. 4.
Figure 6:
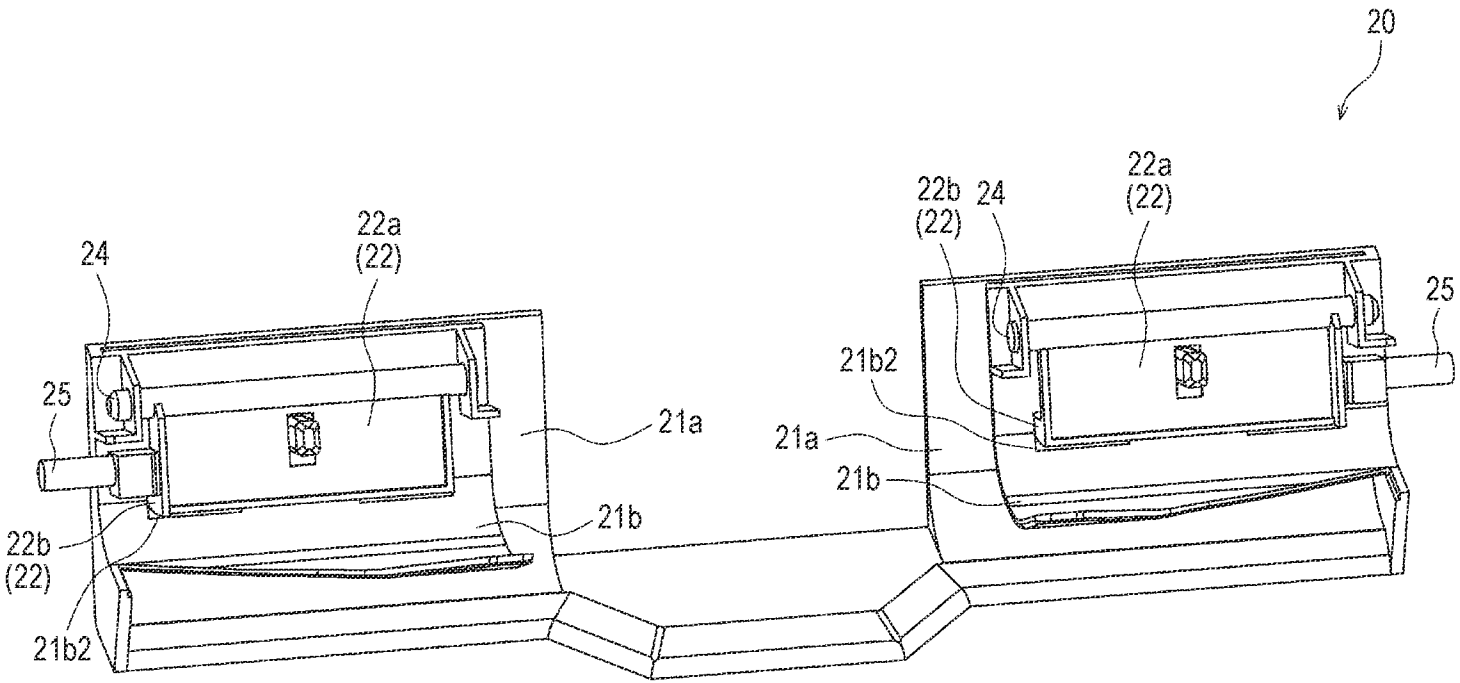
FIG. 6 shows a configuration of an attachment part.

The bottom wall 31 extends in a plane orthogonal to the upper and lower direction, as shown in FIGS. 3 and 5. An upper surface of the bottom wall 31 is configured as a bottom surface 31*a* of the feed tray 11. The sidewalk 32 and 33 extend upward from both left and right end edges of the bottom wall 31. In addition, the sidewalls 32 and 33 extend in the front and rear direction from a front end portion to a rear end portion of the bottom wall 31. The sidewall 34 extends upward from a front end edge of the bottom wall 31. In addition, the sidewall 34 extends along the right and left direction from a right end portion to a left end portion of the bottom wall 31.

Figure 2:
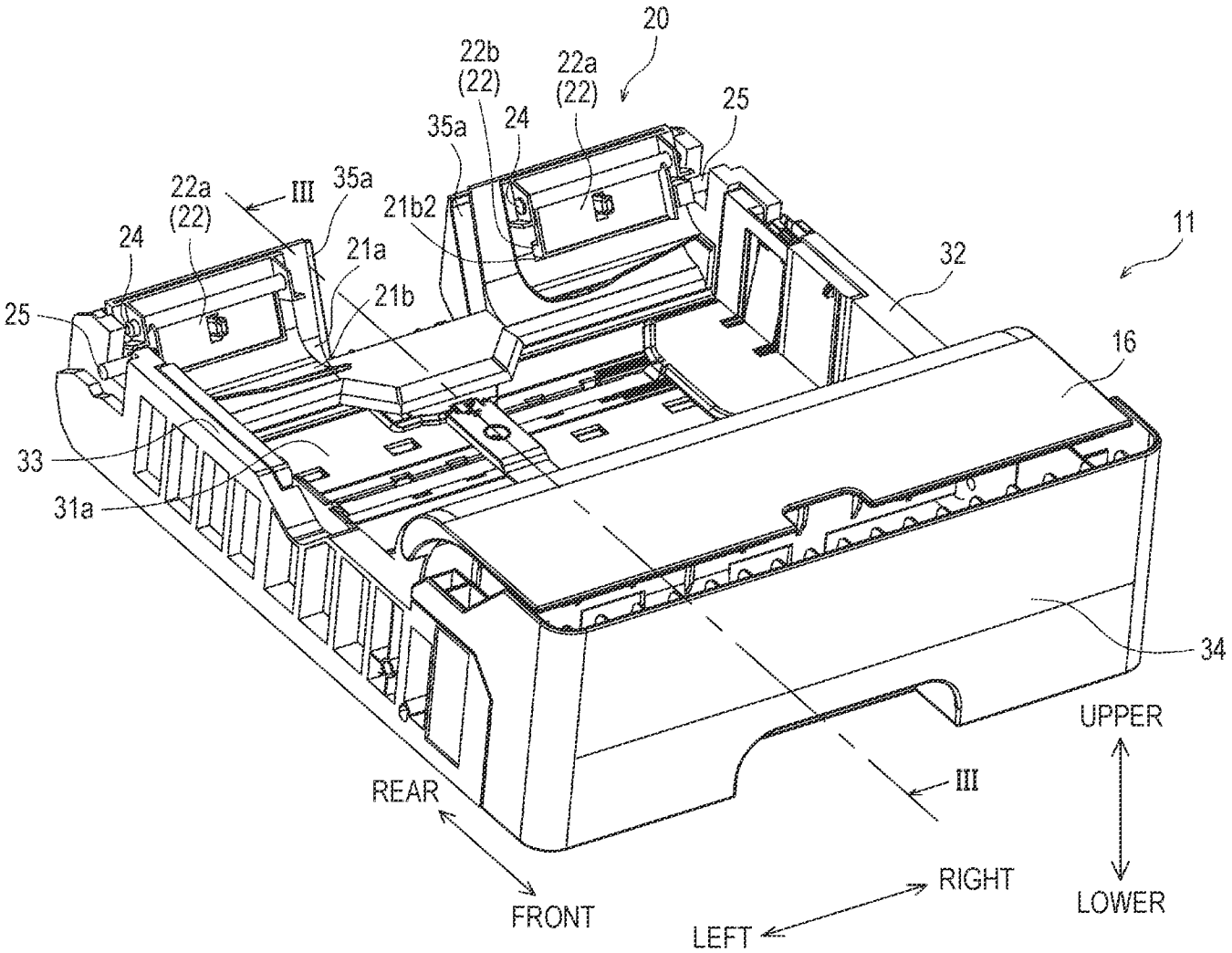
FIG. 2 is a perspective view of a feeding tray shown in FIG. 1 when a shutter is in an intercept position.
Figure 4:
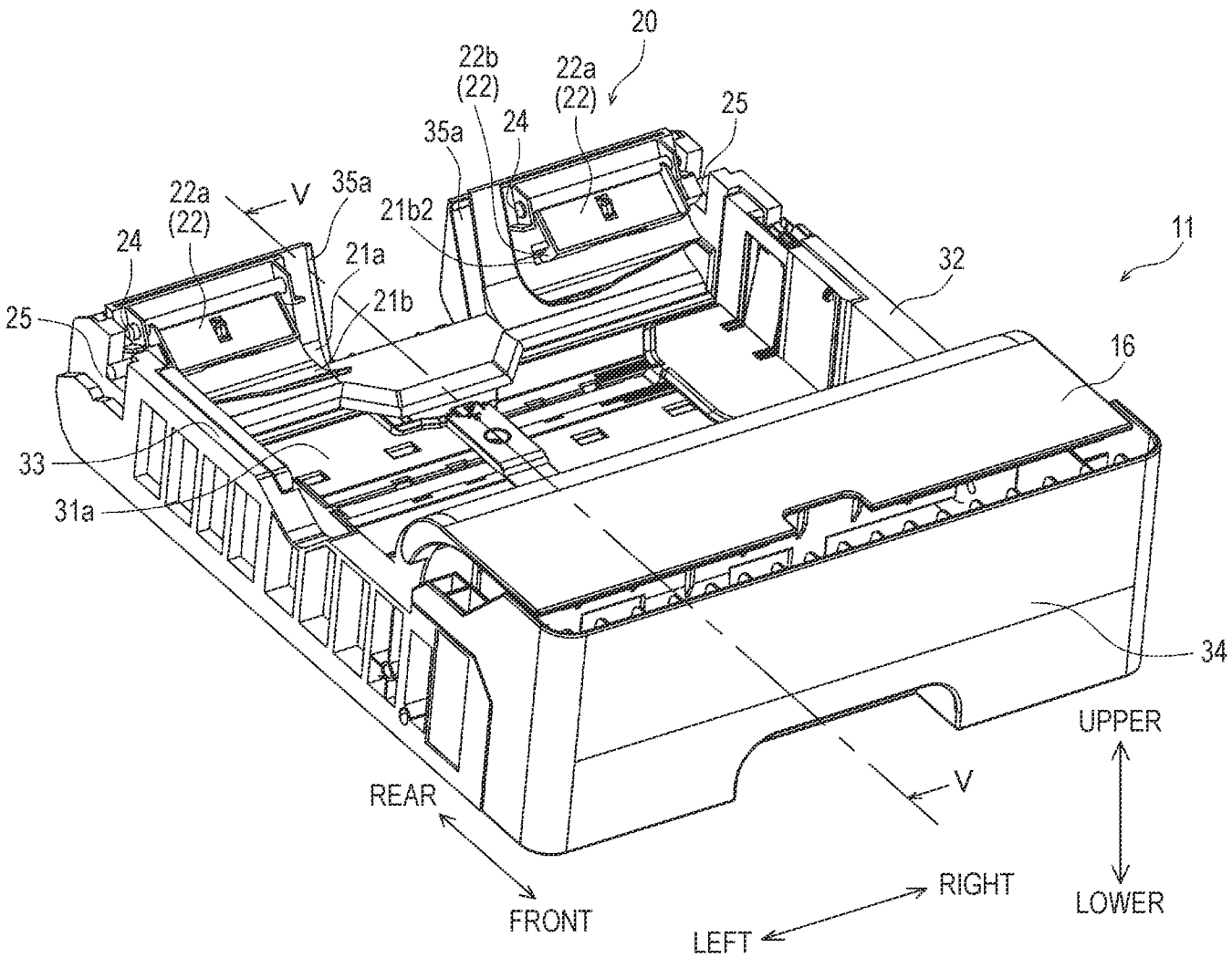
FIG. 4 is a perspective view of the feeding tray shown in FIG. 1 when the shutter is in a retreat position.

The sidewall 35 is provided by four on a rear end edge of the bottom wall 31. In FIGS. 2 and 4, only the two sidewalls on an inner side are shown. The sidewall 35 has a guide surface 35*a* connected to a rear end portion of the bottom surface 31*a* and inclined so that an upper end portion is located further rearward than a lower end portion. The four sidewalls 15 are spaced from each other in the right and left direction. When the feed tray 11 is mounted to the housing 100*a*, the separating piece 41 is located between the two sidewalk 35 on the inner side among the four sidewalls 35 aligned in the right and left direction. When an attachment part 20, which will be described later, is detached from the feed tray 11, the guide surfaces 35*a* of the sidewalls 35 guide obliquely upward the cut sheet P2, which is being conveyed rearward by the feed roller 2, together with the separating piece 41.

As described above, the feed tray 11 is provided therein with the first accommodation part 11*a* capable of accommodating the roll body R and the second accommodation part 11*b* capable of accommodating the cut sheet P2 in a state of being multiply stacked in the upper and lower direction. The first accommodation part 11*a* and the second accommodation part 11*b* are aligned along the conveyance direction. The second accommodation part 11*b* is located on a further downstream side than the first accommodation part 11*a* with respect to the conveyance direction.

The first accommodation part 11*a* is configured to accommodate the roll body R in a posture where an axis direction of the roll body coincides with the right and left direction. As shown in FIG. 3, the first accommodation part 11*a* has a cylindrical core member Rc, a support base 13 and two rollers 14 and 15 configured to support the roll body R, and a roll cover 16. The roll body R has a configuration where the long-length sheet P1 is rolled in a roll shape on an outer peripheral surface of the cylindrical core member Rc. The roll body R is arranged so that an axis direction (a direction perpendicular to the drawing sheet of FIG. 1) along a rotation axis Rx (a central axis of the core member Rc) is parallel to the right and left direction.

The support base 13 extends along the right and left direction. The rollers 14 and 15 all extend in the right and left direction, and are arranged separated from each other in the front and rear direction. The rollers 14 and 15 are all supported on an upper end portion of the support base 13 so as to be rotatable about rotation axes extending in the right and left direction The rollers 14 and 15 are configured to support the roll body R from below in a state of being in contact with an outer peripheral surface of a lower part of the roll body R.

A gap G is formed between a lower surface of the support base 13 and the bottom surface 31*a* of the feed tray 11. When setting the roll sheet P1*a* in the feed tray 11, the roll body R supported on the support base 13 is rotated in a counter-clockwise direction in FIG. 3, and the roll sheet P1*a* is unrolled from a front-side part of the roll body R. Then, the roll sheet P1*a* unrolled from the roll body R passes through the gap G and is pulled out from the front side of the support base 13 to the rear side of the support base 13.

The roll cover 16 is a member configured to cover the roll body R accommodated in the first accommodation part 11*a*. The roll cover 16 extends along the right and left direction and is formed longer than widths of the support base 13 and the rollers 14 and 15. The roll cover 16 is also arranged to be able to be close to the outer peripheral surface of the roll body R of a maximum size that can be accommodated in the first accommodation part 11*a*. As a result, even if the roll body R is loosened and therefore the outer diameter of the roll body R is to increase, the outer peripheral surface of the roll body R comes into contact with an inner surface of the roll cover 16, so that it is possible to restrict an increase in outer diameter. Note that, the roll cover 16 may be detachably mounted to the feed tray 11, and may be configured to be rotatable about a rotary shaft extending along the right and left direction at a lower end thereof. In a case where the roll cover 16 can rotate about the rotary shaft at the lower end thereof, the roll cover 16 can rotate rearward about the rotary shaft, thereby exposing an accommodation space for the roll body R above the support base 13.

Figure 7:
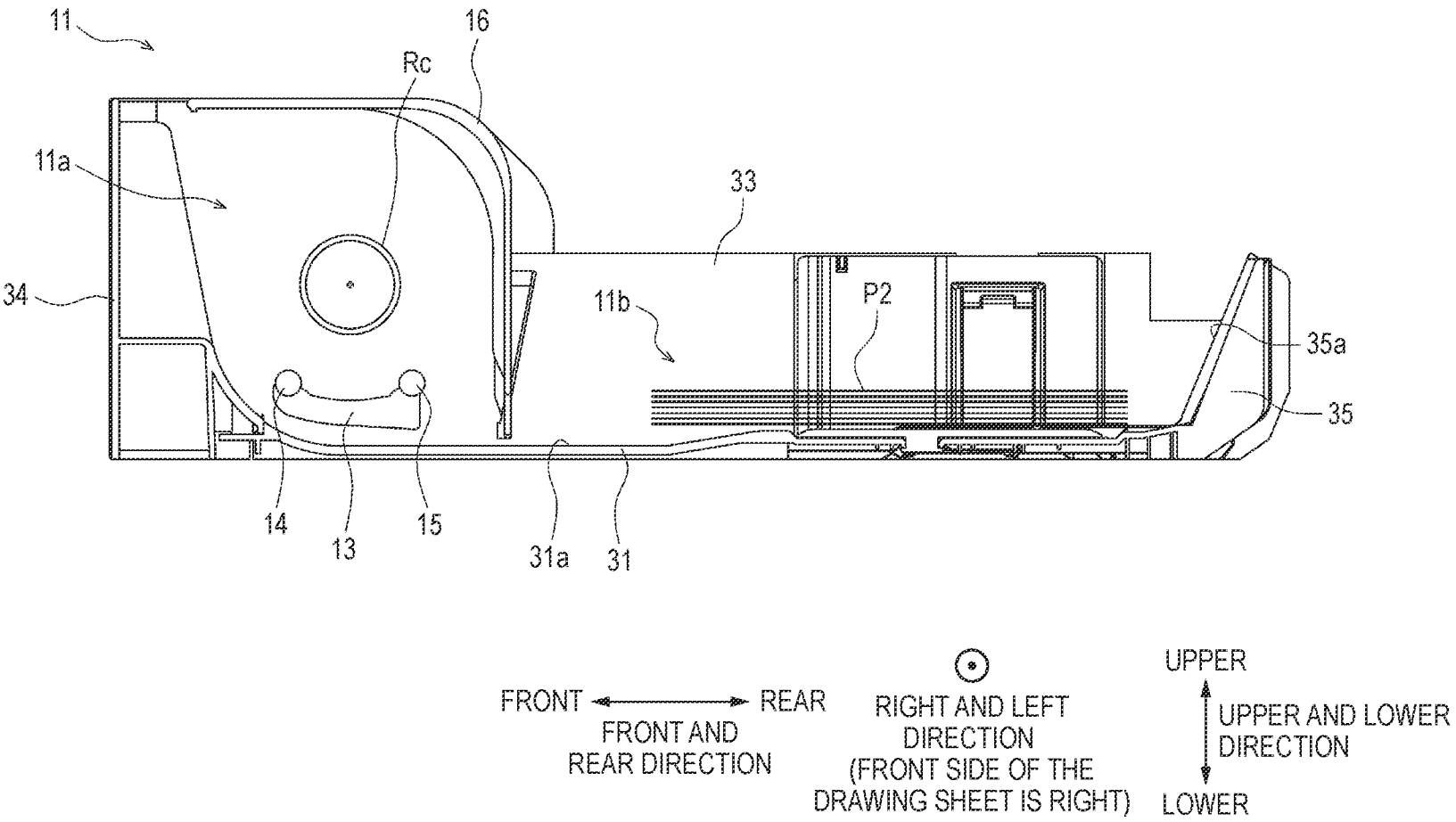
FIG. 7 is a side cross-sectional view of the feeding tray in a state where the attachment part is detached.

The second accommodation part 11*b* is configured to accommodate the cut sheet P2 in a posture where the width direction of the cut sheet coincides with the right and left direction. In the present embodiment, the second accommodation part 11*b* is a rear-side part and an upper-side part of the bottom surface 31*a* of the feed tray 11 with respect to the first accommodation part 11*a*. The rear-side part of the bottom surface 31*a* with respect to the first accommodation part 11*a* is configured to support a plurality of cut sheets P2 placed in a state of being stacked, from below. Note that, in the present embodiment, when accommodating the cut sheet P2 in the second accommodation part 11*b*, an attachment part 20, which will be described later, is detached from the feed tray 11, as shown in FIG. 7. In addition, when performing recording of an image while delivering, from the feed tray 11, the roll sheet P1*a* unrolled from the roll body R accommodated in the first accommodation part 11*a*, the cut sheet P2 is removed from the second accommodation part 11*b*.

The feed tray 11 further has an attachment part 20. The attachment part 20 is attached to a front side of the sidewalk 35 and is configured to be detachably mounted to the feed tray 11. The attachment part 20 includes a conveyance guide 21 and a shutter 22. Note that, in FIG. 1, the shutter 22 is not shown.

The conveyance guide 21 is configured to define a part of the conveyance path for the roll sheet P1*a* unrolled from the roll body R accommodated in the first accommodation part 11*a*. As shown in FIGS. 3 and 5, the conveyance guide 21 has a lower guide 21*a* configured to support the unrolled roll sheet P1*a* from below, and an upper guide 21*b* configured to support the unrolled roll sheet P1*a* from above. The conveyance path for the roll sheet P1*a* is formed between the lower guide 21*a* and the upper guide 21*h*.

The lower guide 21*a* and the upper guide 21*b* extend in the right and left direction. The lower guide 21*a* and the upper guide 21*h* are formed along curves, when seen in the right and left direction. In a state where the feed tray 11 is mounted to the housing 100*a*, the lower guide 21*a* and the upper guide 21*b* are arranged by one on each of both sides of the feed roller 2 in the right and left direction.

The two lower guides 21*a* are each provided on a front side of the guide surfaces 35*a* of the two sidewalls 35 on the right side and on a front side of the guide surfaces 35*a* of the two sidewalls 35 on the left side among the four sidewalls 35. The lower guide 21*a* is provided along the bottom surface 31*a* and the guide surface 35*a*, from an upper side of a rear end part of the bottom wall 31 to a front side of an upper end part of the sidewall 35. The lower guide 21*a* is formed so that it is located upward from the front toward the rear.

The two upper guides 21*b* are provided on an opposite side to the two lower guides 21*a* with the roll sheet P1*a* unrolled from the roll body R being interposed therebetween. The upper guide 21*b* is formed so that a front end portion is above a central portion and a rear end portion is above the front end portion and the central portion, when seen in the right and left direction. In addition, as shown in FIGS. 2 and 4, a central part of the upper guide 21*h* is formed with an opening 21*b*2 in a direction of intersecting with an extension direction of the upper guide 21*b*. In the opening 21*b*2, a tip end portion 22*b* of the shutter 22, which will be described later, can be inserted.

The lower guide 21*a* and the upper guide 21*b* are arranged spaced in a direction orthogonal to the right and left direction. An interval between the lower guide 21*a* and the upper guide 21*b* in the direction orthogonal to the right and left direction becomes narrower from the front toward the rear.

In the present embodiment that, the conveyance path for the roll sheet P1*a* is defined by the feed roller 2, the conveyance guide 2, the intermediate roller pair 9, the pair of conveying rollers 3*a*, and the pair of sheet discharging rollers 3*b*. Note that, as described above, when accommodating the cut sheet P2 in the second accommodation part 11*b*, the attachment part 20 is detached from the feed tray 11. Therefore, in the present embodiment, the conveyance path for the cut sheet P2 is defined by the feed roller 2, the guide surface 35*a* of the sidewall 35, the separating piece 2, the intermediate roller pair 9, the pair of conveying rollers 3*a*, and the pair of sheet discharging rollers 3*b*.

The shutter 22 is arranged by one on each of both sides of the feed roller 2 in the right and left direction. The two shutters 22 each include an arm part 22*a* formed in front of the upper guide 21*b* and a tip end portion 22*b* provided at a tip end of the arm part 22*a*. The arm part 22*a* is formed along the upper part of the upper guide 21*b*. A rear end of the arm part 22*a* is rotatable supported on an upper end part of the upper guide 21*b* by a rotary shaft 24 whose axis direction is the right and left direction. As shown in FIGS. 2 and 4, a left end of the arm part 22*a* on a left side is formed with a convex portion 25 extending leftward in the right and left direction, and a right end of the arm part 22*a* on a right side is formed with a convex portion 25 extending rightward in the right and left direction.

The tip end portion 22*b* extends from the tip end of the arm part 22*a* in a direction of intersecting with the conveyance path defined by the conveyance guide 21. A part of the tip end portion 22*h* passes through the opening 21*b*2 formed at the upper guide 21*b* and is located in the conveyance path defined by the conveyance guide 21.

The shutter 22 is configured to be rotated about the rotary shaft 24 to be movable between an intercept position (refer to FIGS. 2 and 3) where the shutter 122 is located in the conveyance path defined by the conveyance guide 21 and a retreat position (refer to FIGS. 4 and 5) where the shutter 122 is further from the conveyance path than the intercept position. In the present embodiment, the tip end portion 22*b* of the shutter 22 being in the retreat position is located on a further front and upper side than the tip end portion 22*b* of the shutter 22 being in the intercept position. As shown in FIG. 3, when the shutter 22 is in the intercept position, the tip end portion 22*b* penetrates through the conveyance path defined by the conveyance guide 21, In addition, when the shutter 22 is in the intercept position, the shutter 22 is located on a further downstream side than a position directly under the feed roller 2, which is a feed position of the roll sheet P1*a* by the feed roller 2, with respect to the conveyance direction. As shown in FIG. 5, when the shutter 22 is in the retreat position, a tip end of the tip end portion 22*b* retreats out of the conveyance path. When the shutter 22 is in the retreat position, the roll sheet Na that is conveyed by the feed roller 2 passes through the conveyance path defined by the conveyance guide 21 and is guided to the cutter mechanism 4.

Figure 8:
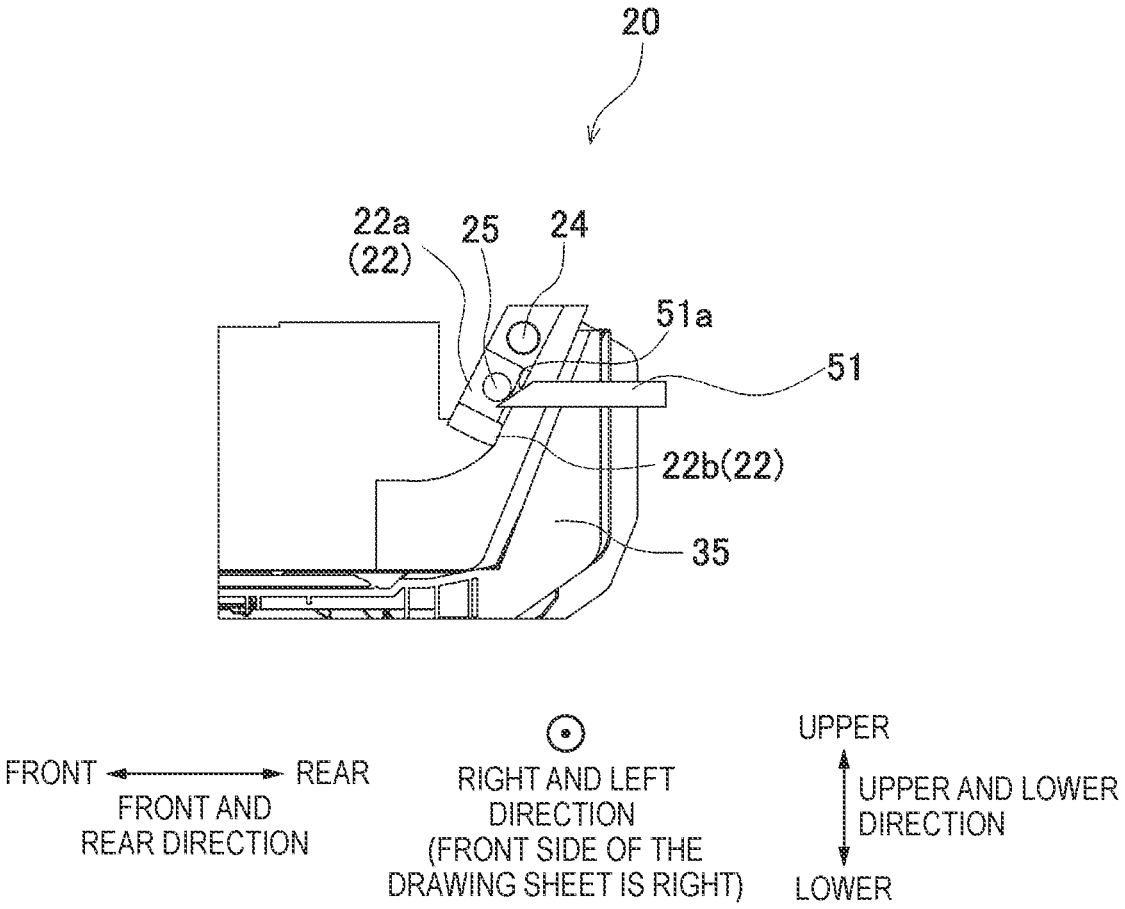
FIG. 8 is a partial side view of the feed tray when the shutter is in the intercept position.
Figure 9:
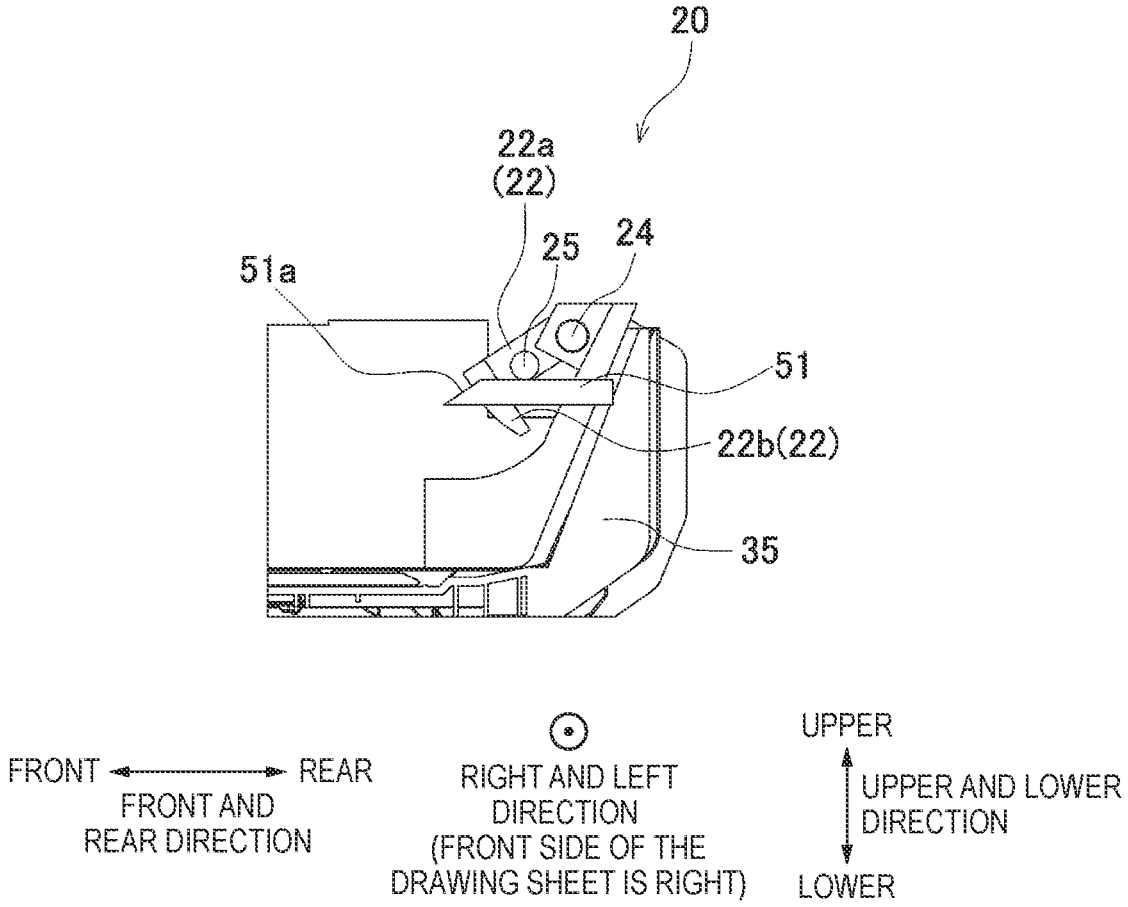
FIG. 9 is a partial side view of the feed tray when the shutter is moved to the retreat position, in conjunction with insertion of the feed tray into a housing.

In addition, the shutter 22 is configured to be movable to the intercept position in conjunction with pullout of the feed tray 11 from the housing 100*a*, and to the retreat position in conjunction with insertion of the feed tray 11 into the housing 100*a*. In the below, the configuration is described in detail with reference to FIGS. 8 and 9.

As described above, the arm part 22*a* of shutter 22 is formed with the convex portion 25. In addition, the housing 100*a* has a protruding portion 51 formed in a position corresponding to the convex portion 25 in the upper and lower direction and in the right and left direction and extending in the front and rear direction. A front end portion of the protruding portion 51 has an inclined surface 51*a* that is included located upward from the front toward the rear.

When the feed tray 11 is inserted into the housing 100*a*, the convex portion 25 moves from front to the rear along the inclined surface 51*a*, and the convex portion 25 gets on the protruding portion 51. This causes the shutter 22 to rotate about the rotary shaft 24 and to move to the retreat position, in conjunction with insertion of the feed tray 11 into the housing 100*a*. In addition, when the feed tray 11 is pulled out from the housing 100*a*, the convex portion 25 moves from the rear to the front along the inclined surface 51*a*, and the convex portion 25 gets down the protruding portion 51. This causes the shutter 22 to rotate about the rotary shaft 24 and to move to the intercept position, in conjunction with pullout of the feed tray 11 from the housing 100*a*.

As described above, the feed tray 11 of the first embodiment has the first accommodation part 11*a* capable of accommodating the roll body R, the conveyance guide 21 configured to define the conveyance path for the roll sheet P1*a* unrolled from the roll body R, and the shutter 22 configured to be movable between the intercept position where the shutter 22 is located in the conveyance path and the retreat position where the shutter 22 is further from the conveyance path than the intercept position. In addition, the printer 100 of the first embodiment has the housing 100*a*, the above-described feed tray 11, the feed roller 2, and the head 5. According to this, by setting the shutter 22 to the intercept position, it is possible to suppress the roll sheet P1*a* unrolled from the roll body R and guided to the conveyance path from becoming excessively long. This makes it possible to suppress the roll sheet P1*a* unrolled from the roll body R from coming into contact with a member inside the housing 100*a* when inserting the feed tray 11 into the housing 100*a* of the printer 100. In addition, by setting the shutter 22 to the retreat position, it is possible to convey the roll sheet P1*a* along the conveyance path.

Further, in the feed tray 11 of the first embodiment, the shutter 22 being in the intercept position is configured to penetrate through the conveyance path defined by the conveyance guide 21. This makes it possible to prevent the roll sheet P1*a* unrolled from the roll body R and guided to the conveyance path from going to a further downstream side than the shutter 22 with respect to the conveyance direction along the conveyance path.

Further, in the feed tray 11 of the first embodiment, the tip end of the tip end portion 22*h* of the shutter 22 being in the retreat position is configured to retreat out of the conveyance path. This makes it possible to prevent the roll sheet P1*a* unrolled from the roll body R and guided to the conveyance path from coming into contact with the shutter 22 when conveying the roll sheet P1*a*.

Further, in the feed tray 11 of the first embodiment, the shutter 22 is configured to be movable to the intercept position, in conjunction with pullout of the feed tray 11 from the housing 100*a*. This makes it possible to take less labor and to avoid forgetting to move the shutter 22 to the intercept position, as compared to a configuration where the shutter 22 is manually moved to the intercept position when pulling out the feed tray 11 from the housing 100*a*. Therefore, it is possible to more securely suppress the roll sheet P1*a* guided to the conveyance path from becoming excessively long, and to more securely suppress the roll sheet P1*a* unrolled from the roll body R from coming into contact with a member inside the housing 100*a* when pulling out the feed tray 11 from the housing 100*a* and then again inserting the feed tray 11 into the housing 100*a*.

Further, in the feed tray 11 of the first embodiment, the shutter 22 is configured to be movable to the retreat position, in conjunction with insertion of the feed tray 11 into the housing 100*a*. Further, in the feed tray 11 of the first embodiment, the shutter 22 is rotatably supported on the conveyance guide 21 by the rotary shaft 24, and is configured to be rotated about the rotary shaft 24 to be movable between the intercept position and the retreat position.

More specifically, in the printer 100 of the first embodiment, the feed tray 1I is configured to be capable of being inserted into pulled out from the housing 100*a* along insertion/pullout direction (front and rear direction) orthogonal to the axis direction (right and left direction) of the roll body R accommodated in the first accommodation part 11*a*. In addition, both ends of the shutter 22 in the right and left direction are formed with the convex portions 25 extending in the right and left direction, and the housing 100*a* has the inclined surfaces 51*a* provided in the positions corresponding to the convex portions 25 in the right and left direction and inclined upward toward a direction (from the front toward the rear) in which the feed tray 11 is inserted into the housing 100*a*. The shutter 22 is rotatably supported on the conveyance guide 21 so that the rotary shaft 24 is directed in the right and left direction, and is configured to rotate about the rotary shaft 24 to be able to thus move to the retreat position as the convex portion 25 moves along the inclined surface 51*a* in conjunction with insertion of the feed tray 11 into the housing 100*a*.

This makes it possible to take less labor and to avoid forgetting to move the shutter 22 to the intercept position, as compared to a configuration where the shutter 22 is manually moved to the intercept position before inserting the feed tray 11 into the housing 100*a*. This makes it possible to suppress a jam due to contact of the roll sheet P1*a* and the shutter 22 during the conveyance operation of the printer 100. In addition, since the shutter 22 rotates and moves, the shutter 22 can easily move between the intercept position and the retreat position.

In addition, the feed tray 11 of the first embodiment further has the second accommodation part 11*b* capable of accommodating the cut sheet P2 in a state of being multiply stacked, and the conveyance guide 21 can be attached and detached to and from the feed tray 11 while supporting the shutters 22. When conveying the cut sheet P2 accommodated in the second accommodation part 11*b*, the conveyance guide 21 and the shutters 22 supported on the conveyance guide 21 are no longer required. In particular, when the number of stacked cut sheets P2 accommodated in the second accommodation part 11*b* is large, the conveyance guide 21 and the shutters 22 may hinder the conveyance of the cut sheet P2. Therefore, in the first embodiment, the conveyance guide 21 is configured to be attachable and detachable to and from the feed tray 11. This makes it possible to securely convey the cut sheet even when the number of stacked cut sheets P2 is large in the feed tray 11 configured to accommodate both the roll body R and the cut sheet P2, and to suppress the roll sheet P1*a* unrolled from the roll body R from coming into contact with a member inside the housing 100*a* when inserting the feed tray 11 into the housing 100*a*.

Further, in the printer 100 of the first embodiment, the shutter 22 is arranged by one on each of both sides of the feed roller 2 in the axis direction (right and left direction) of the roll body R accommodated in the first accommodation part 11*a*. In a case where the shutter 22 is arranged only on one side of the feed roller 2 with respect to the right and left direction, the roll sheet P1*a* unrolled from the roll body R and guided to the conveyance path is suppressed from becoming excessively long only by the shutter 22 arranged on one side of the feed roller 2. Then, the unrolled roll sheet P1*a* may be obliquely tilted with respect to the conveyance direction. In this case, the conveyance of the roll sheet P1*a* by the feed roller 2 after moving the shutter 22 to the retreat position is not appropriately performed. The first embodiment can solve the above problems.

Further, in the printer 100 of the first embodiment, when the shutter 22 is in the intercept position, the shutter 22 is located on a further downstream side than the feed position of the roll sheet P1*a* by the feed roller 2 with respect to the conveyance direction. This makes it possible to securely unroll the roll sheet P1 to the feed position by the feed roller 2.

Subsequently, a configuration of a feed tray 111 according to a second embodiment is described with reference to FIGS. 10 to 13. In descriptions below, the configurations that are similar to the first embodiment are denoted with the same reference signs, and the descriptions thereof are omitted. A printer of the second embodiment has a similar configuration to the printer 100 of the first embodiment, except including the feed tray 111 instead of the feed tray 11 and including a configuration of a protruding portion 151, which will be described later, instead of the protruding portion 51.

The feed tray 111 includes a first accommodation part 111*a* capable of accommodating the roll body R, and a conveyance guide 121 configured to define the conveyance path for the roll sheet P1*a* unrolled from the roll body R. The conveyance guide 121 includes a first member 121*a* and a second member 121*b* extending in the insertion/pullout direction of the feed tray 111 with respect to the housing 100*a*, i.e., in the front and rear direction.

Figure 11:
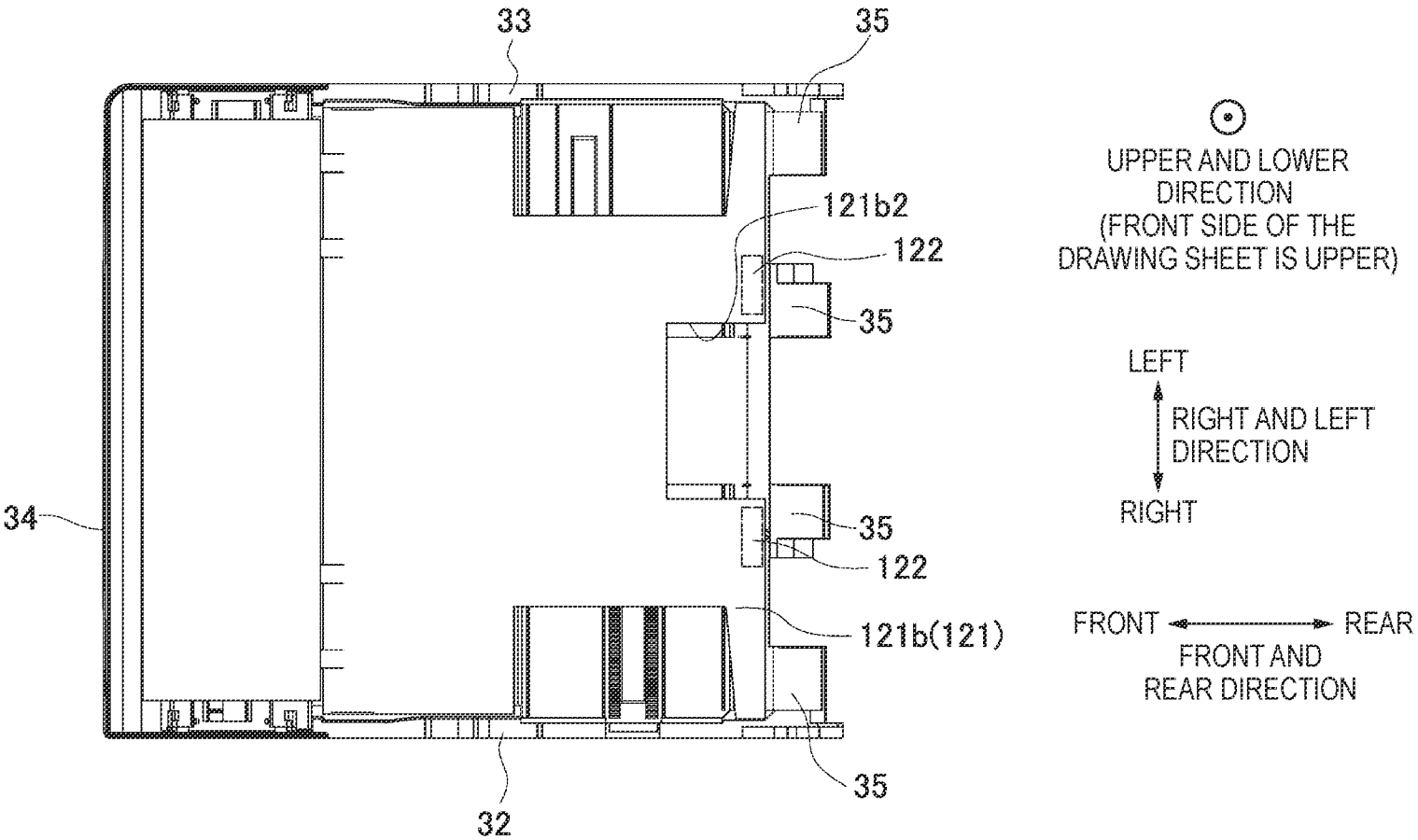
FIG. 11 is a top view of the feed tray according to the second embodiment.

The first member 121*a* is configured to support the roll sheet P1*a* unrolled from the roll body R accommodated in the first accommodation part 111*a*, from below. The second member 121*b* is located above the first member 121*a*. As shown in FIG. 11, a rear end part of the second member 121*b*, which is a central part in the right and left direction, is formed with a notch 121*b*2. The conveyance path for the roll sheet P1*a* is formed between the first member 121*a* and the second member 121*b*. The roll sheet P1*a* unrolled from the roll body R passes through the conveyance path, is sent to a downstream side with respect to the conveyance direction and comes into contact with the feed roller 2 from the part of the second member 121*b*, at which the notch 121*b*2 is formed, so that the roll sheet is fed to a further downstream side with respect to the conveyance direction.

In addition, in the second embodiment, the cut sheet P2 in a state of being multiply stacked can be placed on an upper surface of the second member 121*b*, This allows the feed tray 111 to accommodate the plurality of cut sheets P2.

Figure 12:
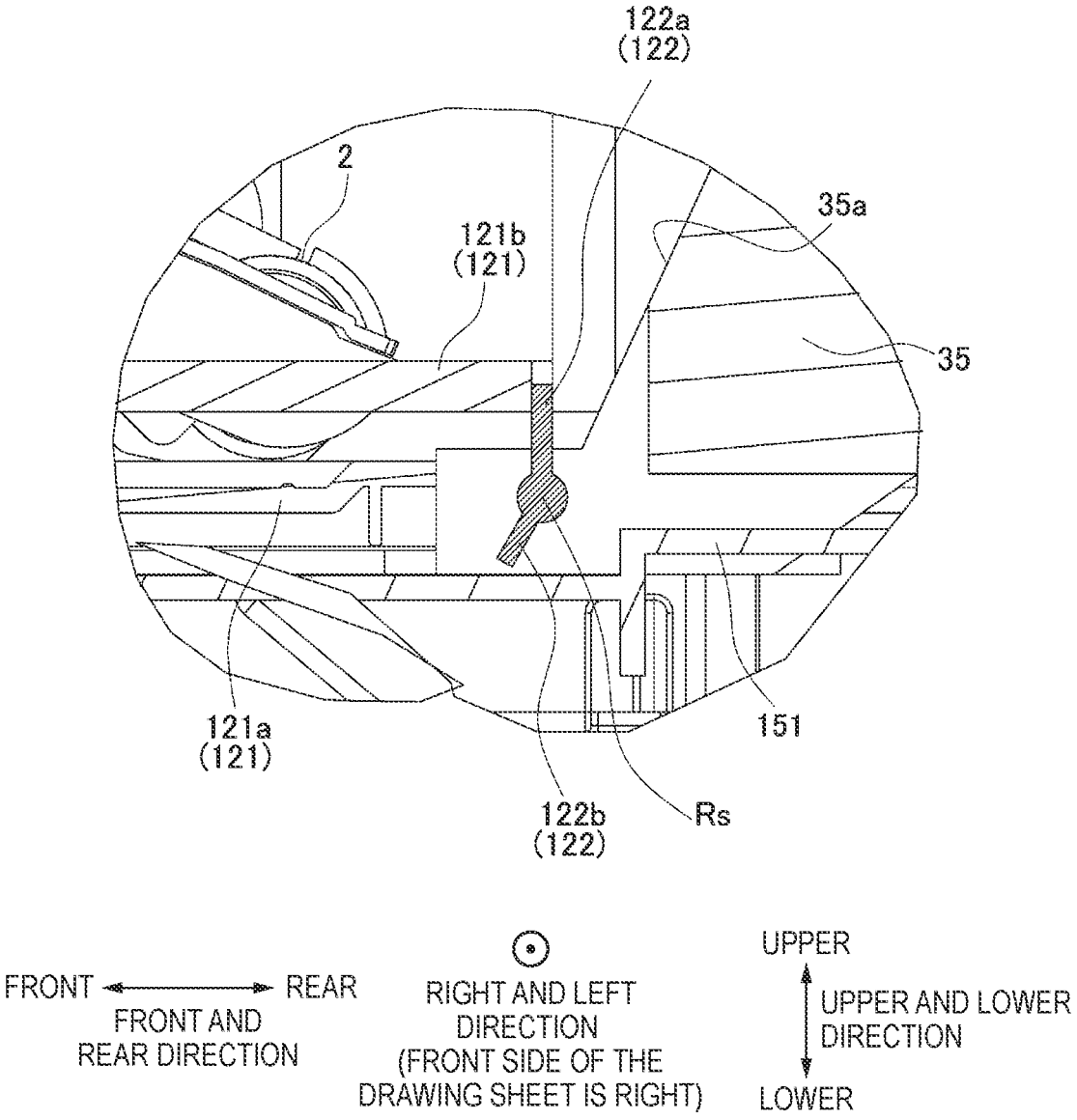
FIG. 12 is a partial side view of the feed tray according to the second embodiment when the shutter is in the intercept position.

The feed tray 111 further includes a shutter 122 configured to be movable between an intercept position where the shutter 122 is located in the conveyance path defined by the conveyance guide 121 and a retreat position where the shutter 122 is further from the conveyance path than the intercept position. The shutter 122 includes a first part 122*a* and a second part 122*b*. The shutter 122 is rotatably supported on the first member 121*a* so that a rotary shaft Rs is directed in the right and left direction. The shutter 122 is urged by an urging member (not shown) so as to be in the intercept position shown in FIG. 12. Specifically, an elastic force for rotating the shutter 122 in a counterclockwise direction in FIG. 12 is applied from the urging member to the shutter 122. The urging member is, for example, a spring.

As shown in FIG. 11, the shutter 122 is arranged by one on each of both sides of the notch 121*b*2 in the right and left direction. In other words, the shutter 122 is arranged by one on each of both sides of the feed roller 2 in the right and left direction. When the shutter 122 is in the intercept position, the shutter 122 is arranged on a further downstream side than the feed position of the roll sheet P1*a* by the feed roller 2 with respect to the conveyance direction (refer to FIGS. 12 and 13).

Figure 10:
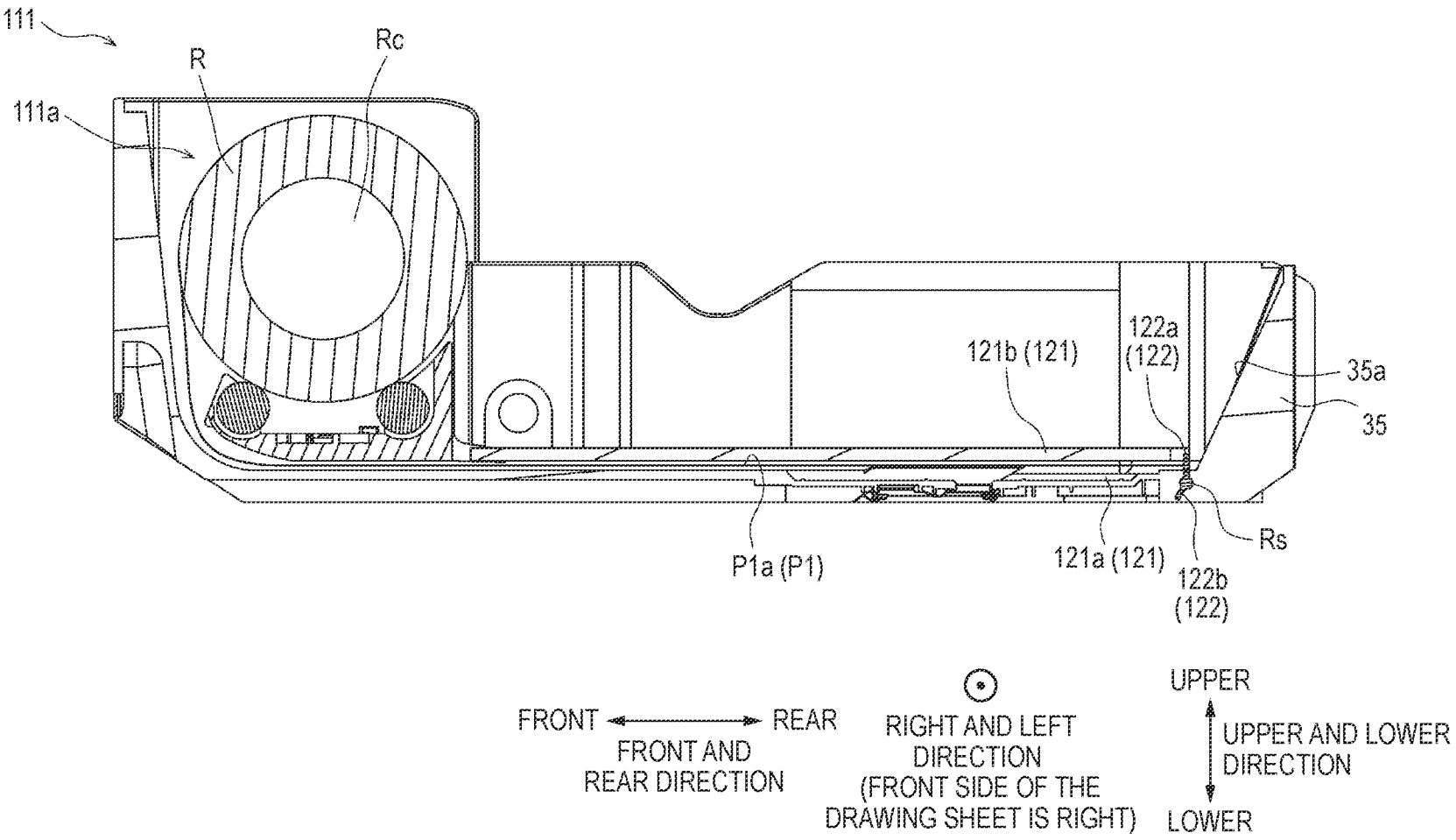
FIG. 10 is a side cross-sectional view of a feed tray according to a second embodiment of the present disclosure.

As shown in FIG. 10, the first part 122*a* is located above the second part 122*b* and on an opposite side to the second part 122*b* with respect to the rotary shaft Rs. The shutter 22 is configured to rotate about the rotary shaft Rs by the elastic force applied by the urging member, and to be in the intercept position as a result of the first part 122*a* coming into contact with the second part 122*b*. That is, in the second embodiment, when the shutter 122 is in the intercept position, the first part 122*a* is in linear contact with a lower surface of the second part 121*b* of the conveyance guide 121. In other words, when the shutter 122 is in the intercept position, the first part 122*a* penetrates through the conveyance path defined by the conveyance guide 121.

In the present embodiment, the shutter 122 is configured to be movable to the retreat position in conjunction with insertion of the feed tray 111 into the housing 100*a*. The housing 100*a* of the printer of the second embodiment has a protruding portion 151 formed in a position corresponding to the second part 122*b* of the shutter 122 in the upper and lower direction and in the right and left direction and extending in the front and rear direction.

Figure 13:
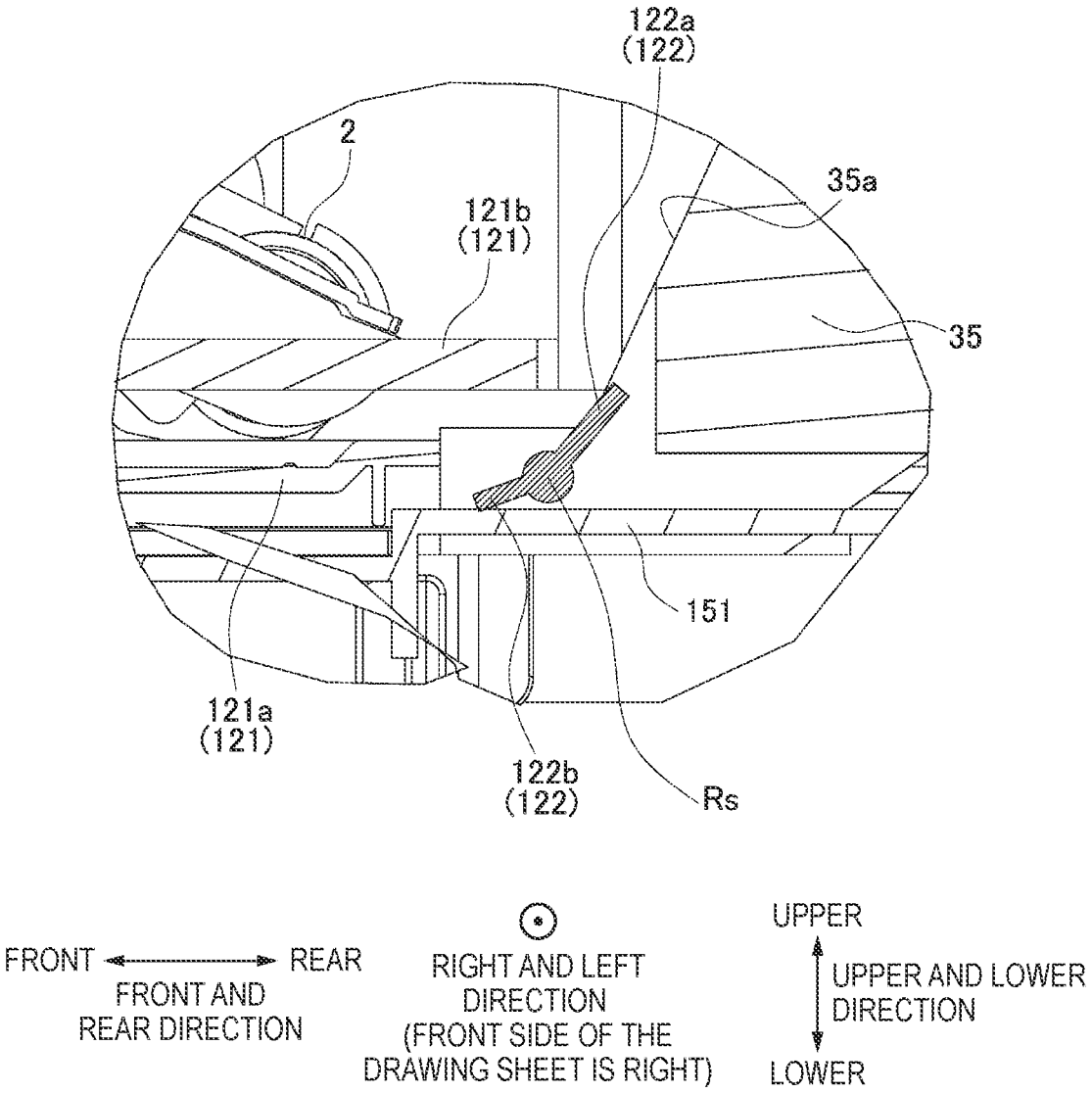
FIG. 13 is a partial side view of the feed tray when the shutter is in the retreat position.

When the feed tray 111 is inserted into the housing 100*a*, the second part 122*b* is pushed by the protruding portion 151, so that the shutter 122 rotates in a clockwise direction about the rotary shaft Rs against the elastic force of the urging member and the first part 122*a* retreats from the conveyance path in conjunction with movement of the second part 122*b*. This causes the shutter 122 to rotate about the rotary shaft Rs and to move to the retreat position, in conjunction with insertion of the feed tray 111 into the housing 100*a*. Note that, as shown in FIG. 13, when the shutter 122 is in the retreat position, the first part 122*a* of the shutter 122 retreats out of the conveyance path. Note that, in the second embodiment, when the shutter 122 is in the retreat position, the roll sheet P1*a* fed by the feed roller 2 passes through the conveyance path defined by the conveyance guide 121, is sent to the guide surface 35*a* of the sidewall 35, and is guided to the cutter mechanism 4 by the guide surface 35*a*.

In addition, in the present embodiment, the shutter 122 is configured to be movable to the intercept position in conjunction with pullout of the feed tray 111 from the housing 100*a*. As described above, when seen from the right and left direction, the shutter 122 is urged by the urging member (not shown) so as to be a position (a position in FIG. 12), i.e., the intercept position where the first part 122*a* is in contact with the second member 121*b*. When the feed tray 111 is pulled out from the housing 100*a*, the push-up of the second part 122*b* by the protruding portion 151 is released, so that the shutter 122 rotates about the rotary shaft Rs and the first part 122*a* returns to the position where the first part is in contact with the second member 12*l* b. This causes the shutter 122 to rotate about the rotary shaft 24 and to move to the intercept position, in conjunction with pullout of the feed tray 111 from the housing 100*a*.

As described above, in the feed tray 111 of the second embodiment, the conveyance guide 121 includes the first member 121*a* and the second member 121*b* extending in the insertion/pullout direction (front and rear direction) of the feed tray 111 with respect to the housing 100*a*, and the conveyance path for the roll sheet P1*a* is formed between the first member 121*a* and the second member 121*b*. In addition, the shutter 122 is rotatably supported on the first member 121*a* so that the axis direction (right and left direction) of the roll body R accommodated in the first accommodation part 111*a* is the direction of the rotary shaft Rs. The shutter 122 is configured to be rotated about the rotary shaft Rs to be movable between the intercept position and the retreat position, and is in the intercept position as the first part 122*a* of the shutter 122 comes into contact with the second member 121*b*. According to this, since the shutter 22 rotates, the shutter can easily move between the intercept position and the retreat position. In addition, the shutter 122 can be set to the intercept position by using the second member 121*b* of the conveyance guide 121.

Further, in the feed tray 111 of the second embodiment, the second member 121*b* is located above the first member 121*a*, and the cut sheet P2 can be accommodated in a state of being multiply stacked on the upper surface of the second member 121*b*. This makes it possible to suppress the roll sheet P1*a* unrolled from the roll body R from coming into contact with a member inside the housing 100*a* when inserting the feed tray 111 into the housing 100*a*, in the feed tray 111 configured to accommodate both the roll body R and the cut sheet P2.

Further, in the printer of the second embodiment, the housing 100*a* is formed with the protruding portion 151 extending in the insertion/pullout direction (front and rear direction) of the feed tray 111 with respect to the housing 100*a*. The second part 122*b* is pushed by the protruding portion 151 in conjunction with the insertion of the feed tray 111 into the housing 100*a*, so that the shutter 122 can rotate about the rotary shaft Rs to move to the retreat position. This makes it possible to take less labor and to avoid forgetting to move the shutter 122 to the intercept position, as compared to a configuration where the shutter 122 is manually moved to the intercept position before inserting the feed tray 111 into the housing 100*a*. This makes it possible to suppress a jam due to contact of the roll sheet P1*a* and the shutter 122 during the conveyance operation of Printer name.

MODIFIED EMBODIMENTS

Although the preferred embodiments of the present disclosure have been described, the present invention is not limited to the above-described embodiments, and can be variously changed within the claims.

In the above-described embodiments, the feed tray enables to accommodate the roll body R and the cut sheet P2. However, the feed tray of the present disclosure may also be configured to be able to accommodate only the roll body.

In the above-described embodiments, the shutter is arranged by one on each of both sides of the feed roller 2 in the right and left direction. However, the shutter may also be arranged by two or more on each of both sides of the feed roller 2 in the right and left direction or may also be arranged only on one side of the feed roller, and the numbers of shutters to be arranged on both sides may be different. However, preferably, the shutter is arranged by at least one on each of both sides of the feed roller 2 in the right and left direction.

In the feed tray 11 of the first embodiment, the lower guide 21*a* and the upper guide 21*b* may be arranged by two or more on each of both sides of the feed roller 2 or may be arranged by one on each of both sides of the feed roller 2 in the right and left direction in a state where the feed tray 11 is mounted to the housing 100*a*.

In the above-described embodiments, the shutter is rotatably supported on the conveyance guide but may also be rotatably supported directly on the feed tray. In addition, the shutter may be configured to be movable between the intercept position and the retreat position, and is not limited to the configuration of rotating about the rotary shaft.

In the above-described embodiments, when the shutter is in the intercept position, the roll sheet P1*a* unrolled from the roll body R is in contact with the shutter. However, when the shutter is in the intercept position, the shutter may not completely intercept the conveyance path. In this case, the shutter being in the intercept position may not be in contact with the roll sheet P1*a* unrolled from the roll body R.

In the above-described embodiments, the shutter is configured to be movable to the intercept position in conjunction with pullout of the feed tray from the housing. However, the shutter may also be configured to be manually movable to the intercept position. In addition, in the above-described embodiments, the shutter is configured to be movable to the retreat position in conjunction with insertion of the feed tray into the housing. However, the shutter may also be configured to be manually movable to the retreat position.

In the above-described embodiments, when the shutter is in the retreat position, the tip end of the shutter retreats out of the conveyance path defined by the conveyance guide. However, when the shutter is in the retreat position, the tip end of the shutter may remain in the conveyance path defined by the conveyance guide. Note that, in this case, the feed tray is configured so that, even when the tip end of the shutter being in the retreat position remains in the conveyance path, the roll sheet P1*a* unrolled from the roll body R can pass through the conveyance path defined by the conveyance guide.

In the above-described embodiments, the shutter being in the intercept position is configured to penetrate through the conveyance path. However, the shutter being in the intercept position may also be configured not to penetrate through the conveyance path. For example, the shutter being in the intercept position may be configured to be in contact with an inner surface of the conveyance guide defining the conveyance path.

In the first embodiment, the conveyance guide 21 has the lower guide 21*a* and the upper guide 21*b* but may not have the lower guide 21*a* in this case, the conveyance path for the roll sheet P1*a* is formed between the upper guide 21*b* and the guide surface 35*a* of the sidewall 35. In other words, the conveyance guide includes the upper guide 21*b* and the guide surface 35*a*.

Further, in the first embodiment, the shutter 22 is rotatably supported on the upper guide 21*b*. However, the shutter 22 may not be supported on the upper guide 21*b*. For example, the upper guide 21*b* and the shutter 22 may also be integrally configured. For example, the upper guide may be formed with a shutter part (corresponding the shutter of the present disclosure) extending into the conveyance path. In this case, the upper guide is configured to be rotatable about the right and left direction that is a rotation axis, and the shutter part is configured to move between the intercept position and the retreat position in conjunction with rotation of the upper guide.

The image recording apparatus of the present disclosure can also be applied to a complex machine, a copier and the like, in addition to the printer. In addition, the printer may be applied to not only the inkjet printer but also a laser-type printer configured to form an electrostatic latent image by exposing a photosensitive member by laser or an LED-type electrophotographic printer configured to form an electrostatic latent image by exposing a photosensitive member by an LED. In addition, the sheet-shaped medium is not limited to the sheet and may also be a cloth, a label or the like as long as it is a sheet type.

What is claimed is:

1. An image recording apparatus comprising:

a housing;

a feed tray configured to be capable of being inserted into and pulled out from the housing, the feed tray comprising:

a first accommodation part in which a roll body having a configuration where a first sheet-shaped medium is rolled in a roll shape is accommodated;

a conveyance guide configured to define a conveyance path for a roll medium which is the first sheet-shaped medium unrolled from the roll body accommodated in the first accommodation part; and a shutter movable between an intercept position where the shutter is located in the conveyance path and a retreat position in which the shutter is further from the conveyance path than when in the intercept position;

a feed roller configured to feed the roll medium from the feed tray by applying a feeding force to the roll medium; and a recording unit configured to record an image on the roll medium fed by the feed roller, wherein the feed tray is configured to be capable of being inserted into and pulled out from the housing along an insertion/pullout direction orthogonal to an axis direction of the roll body accommodated in the first accommodation part, both ends of the shutter in the axis direction are formed with convex portions extending in the axis direction, the housing has, in positions corresponding to the convex portions in the axis direction, inclined surfaces inclined upward toward a direction in which the feed tray is inserted into the housing, the shutter is rotatably supported on the conveyance guide, the shutter having a rotary shaft extending in the axis direction, and the shutter is configured to rotate about the rotary shaft to be movable to the retreat position, as the convex portions move along the inclined surfaces in conjunction with insertion of the feed tray into the housing.

2. The image recording apparatus according to claim 1, wherein the shutter is arranged by at least one on each of both sides of the feed roller in an axis direction of the roll body accommodated in the first accommodation part.

3. The image recording apparatus according to claim 1, wherein the housing is formed with a protruding portion extending in the insertion/pullout direction of the feed tray with respect to the housing, the conveyance guide includes a first member and a second member extending along the insertion/pullout direction, and the conveyance path for the roll medium is formed between the first member and the second member, the shutter is rotatably supported on the first member, the shutter is configured to be in the intercept position as a first part of the shutter comes into contact with the second member, and the shutter is configured to rotate about the rotary shaft to be movable to the retreat position, as a second part of the shutter located on an opposite side to the first part with respect to the rotary shaft is pushed by the protruding portion in conjunction with insertion of the feed tray into the housing.

4. The image recording apparatus according to claim 1, when the shutter is in the intercept position, the shutter is located farther downstream side in a conveyance direction along the conveyance path than a feed position of the roll medium fed by the feed roller.

5. The image recording apparatus according to claim 1, wherein the conveyance guide includes a first member and a second member extending along the insertion/pullout direction, and the conveyance path for the roll medium is formed between the first member and the second member, and wherein the shutter comes into contact with the second member in the insertion/pullout direction to be in the intercept position.

* * * * *